US005862731A

United States Patent [19]

Chen

[11] Patent Number: 5,862,731

[45] Date of Patent: Jan. 26, 1999

[54] MULTIFUNCTIONAL WORKBENCH FOR WOODWORKING

[76] Inventor: Fu-Yuan Chen, No. 170-18, Hsing Nung Lane, Hsi-Nan Rd., Wu Ri Hsian, Taichung Hsien, Taiwan

[21] Appl. No.: 903,445

[22] Filed: Jul. 30, 1997

[51] Int. Cl.[6] ..... B26D 7/02

[52] U.S. Cl. ..... 83/467.1; 83/468.7; 83/459; 144/286.1; 144/307; 144/308; 144/253.1; 269/303; 269/901

[58] Field of Search ..... 83/459, 467.1, 83/468.7, 471.3, 759; 144/1.1, 286.1, 286.5, 253.1, 306, 307, 308; 269/289 R, 290, 291, 292, 293, 303, 300, 305, 315, 901

[56] References Cited

U.S. PATENT DOCUMENTS 4,415,149 11/1983 Rees ..... 269/901
5,040,443 8/1991 Price ..... 144/287
5,605,086 2/1997 Huang-Mo et al. ..... 83/467.1
5,644,964 7/1997 Price ..... 269/303
5,720,096 2/1998 Dorsey ..... 269/303

*Primary Examiner*—W. Donald Bray
*Attorney, Agent, or Firm*—Browdy and Neimark

[57] ABSTRACT

A workbench for woodworking is composed of a foldable support frame for supporting the workbench on the floor of a work shop, a bench top supported on the support frame and composed of one fixed top plate and one movable top plate, a locating and holding set mounted on the bench top for holding and locating a work piece in accordance with the shape of the work piece, and a cutting set consisting of a locating seat, a rotary seat, a fastening bolt, a spring, and a hand saw capable of being actuated to swivel for an angle corresponding to a swiveling angle of the rotary seat which is caused to swivel along with the locating seat.

3 Claims, 3 Drawing Sheets

MULTIFUNCTIONAL WORKBENCH FOR WOODWORKING

FIELD OF THE INVENTION

The present invention relates generally to a workbench, and more particularly to a multifunctional workbench intended for use in woodworking.

BACKGROUND OF THE INVENTION

The conventional workbench is generally rather limited in design in that it is capable of doing simple tasks, such as the holding and the locating of a work piece but is not equipped to do something more sophisticated than the holding and the locating of a work piece. In addition to the holding and the locating of a work piece, woodworking involves the cutting of a work piece at various angles. The conventional workbench does not fulfill this need and the expectations of a professional carpenter or do-it-yourselfer.

SUMMARY OF THE INVENTION

The primary objective of the present invention is to provide a multifunctional workbench enabling a worker to cut a work piece at various angles.

In keeping with the principle of the present invention, the foregoing objective of the present invention is attained by a workbench consisting of a foldable support frame, a movable bench top, a locating set, and a cutting set. The cutting set is mounted on the movable bench top and is composed of two rotary frames on which two parallel support rods are mounted for fastening a saw. The rotary frames can be swiveled such that the rotary frames form a predetermined angle with the locating seat of the rotary frames.

The foregoing objective, features and functions of the present invention will be more readily understood upon a thoughtful deliberation of the following detailed description of an embodiment of the present invention with reference to the accompanying drawings.

DETAILED DESCRIPTION OF THE INVENTION

Figure 1:
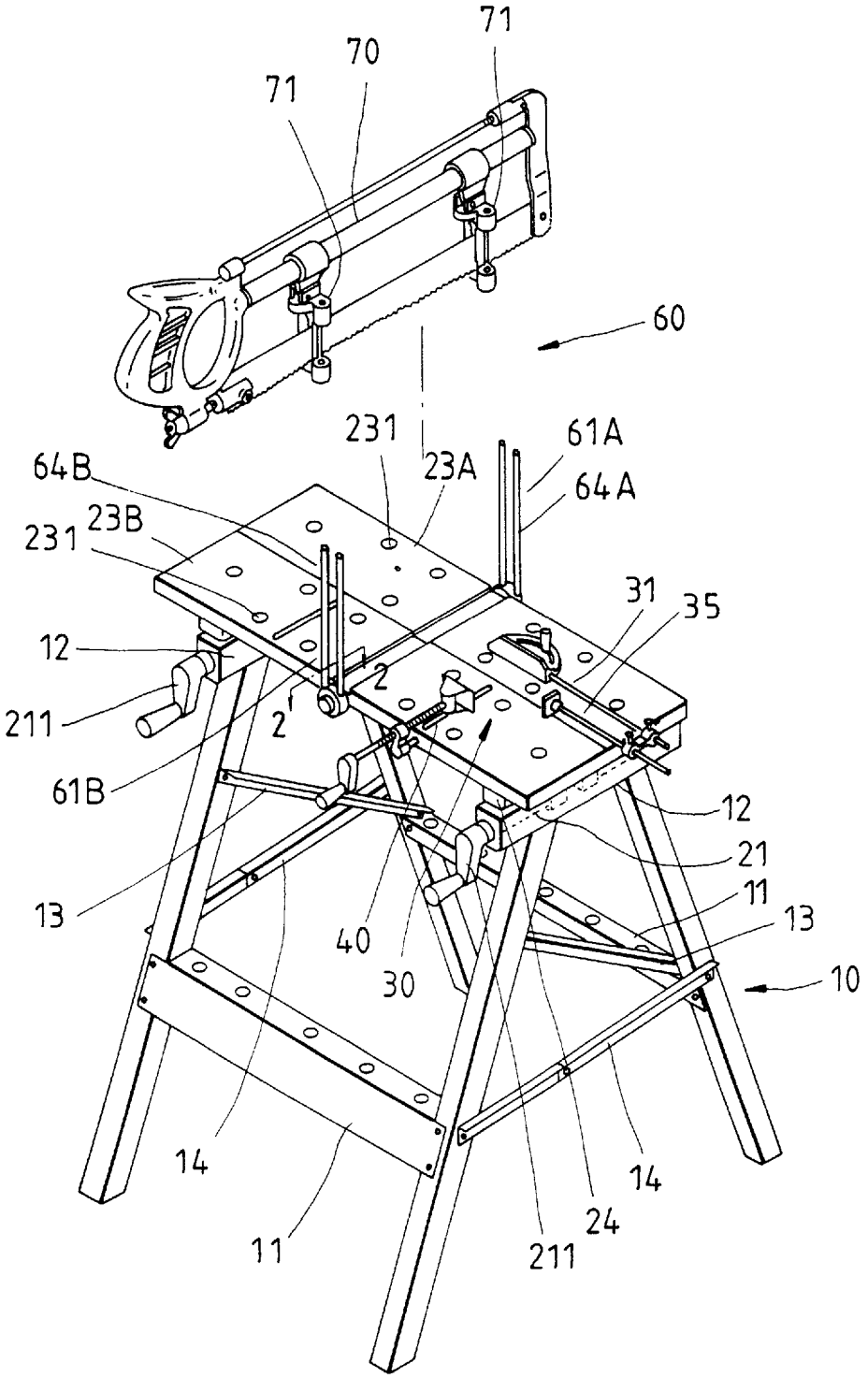
FIG. 1 shows a perspective view of the embodiment of the present invention.
Figure 2:
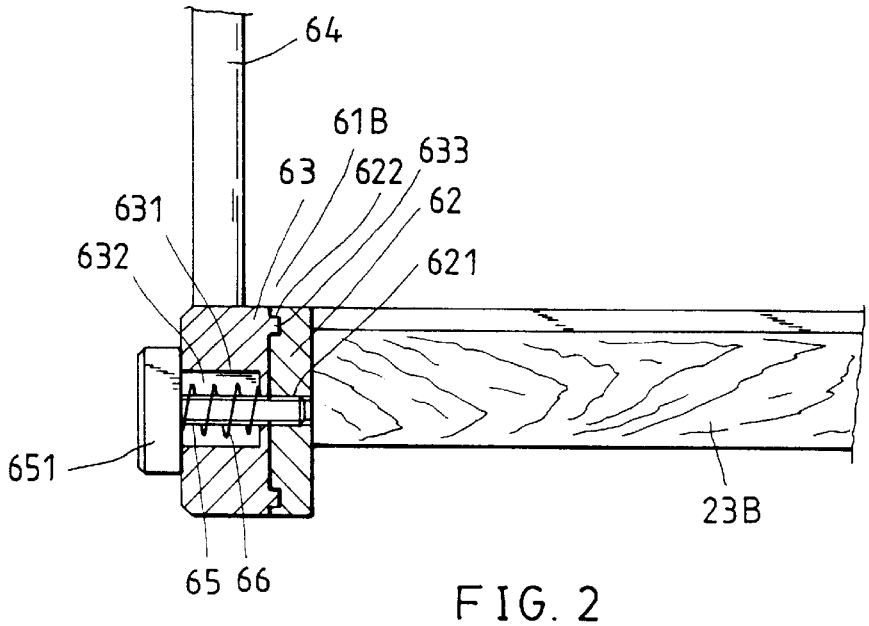
FIG. 2 shows a sectional view of a portion taken along the direction indicated by a line 2—2 as shown in FIG. 1.
Figure 4:
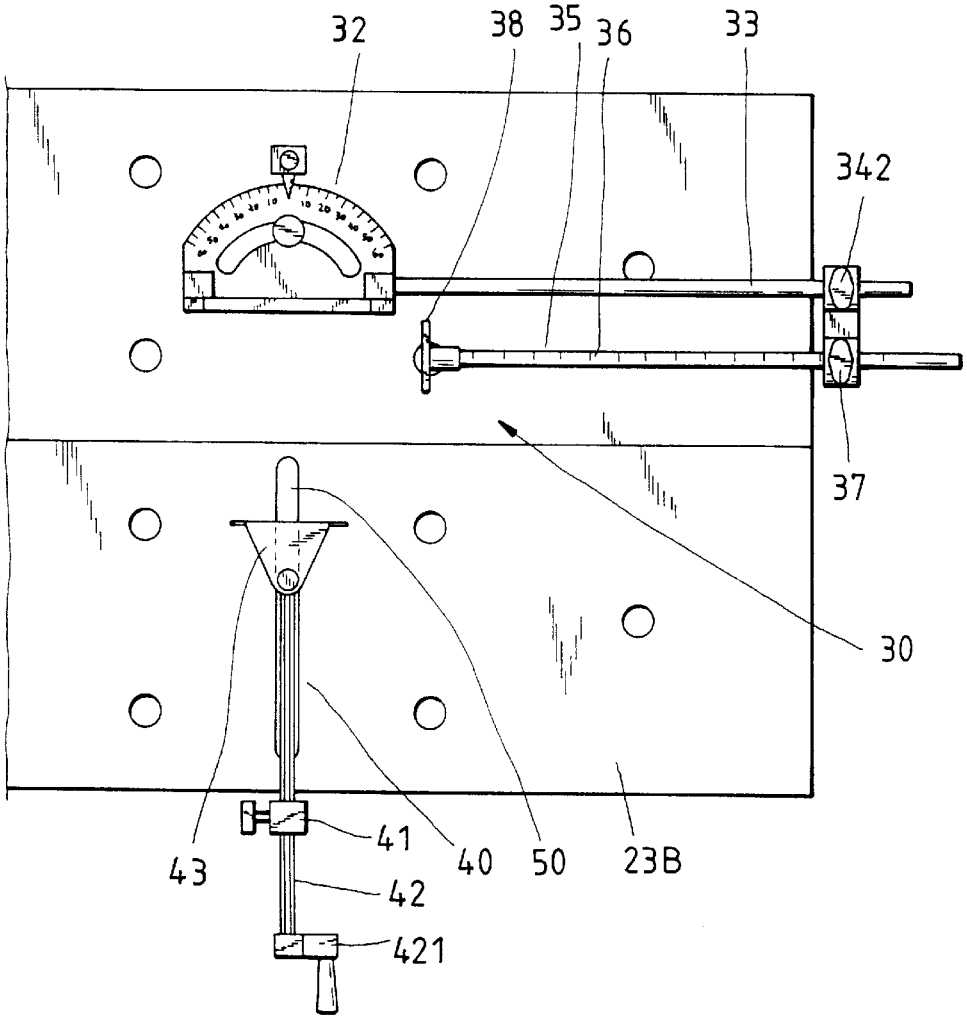
FIG. 4 shows a top view of the embodiment as shown in FIG. 3.
Figure 3:
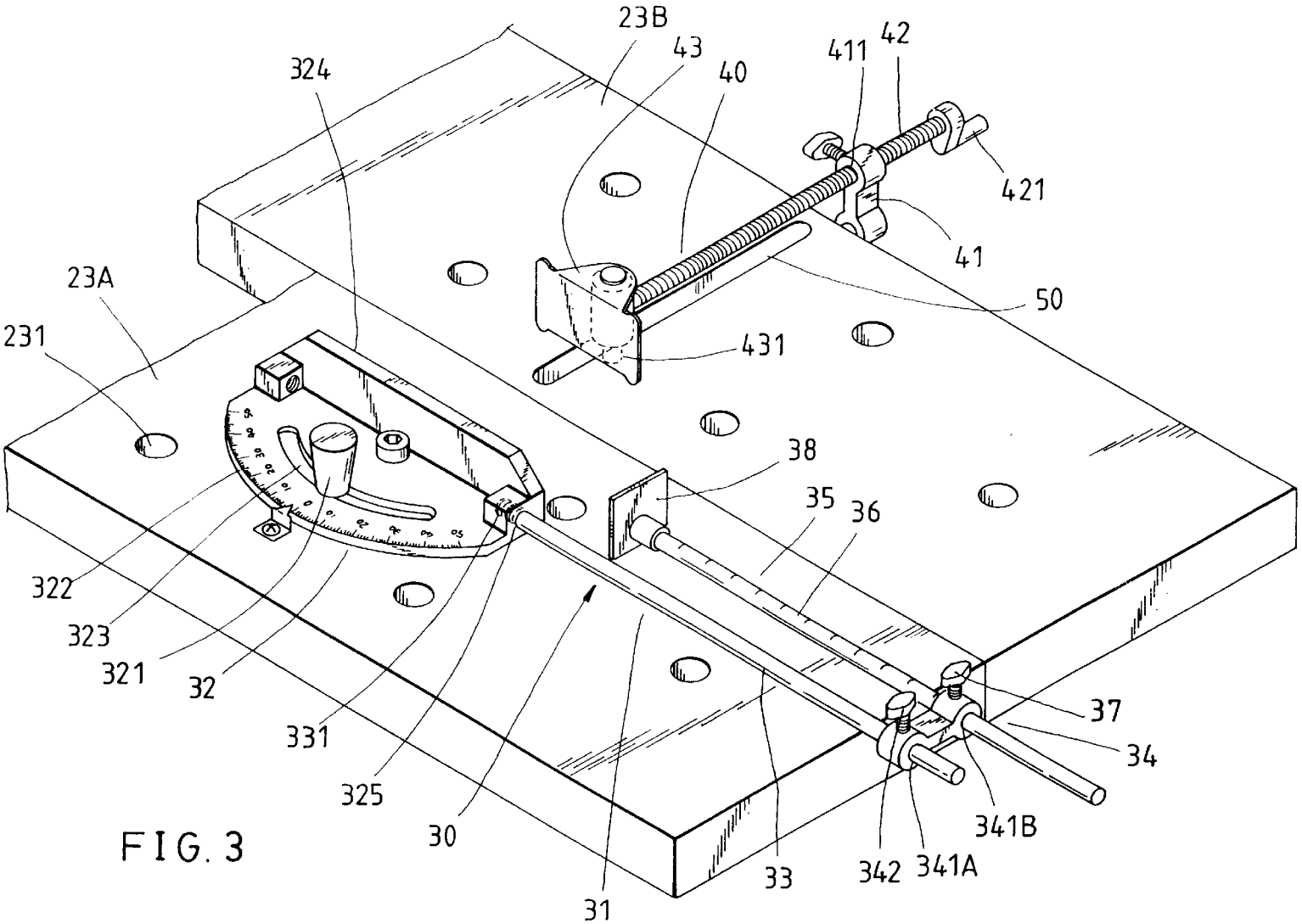
FIG. 3 shows a partial enlarged view of the embodiment of the present invention.

As shown in FIGS. 1–4, a workbench embodied in the present invention is composed of a support frame 10, a movable bench top 20, a locating and holding set 30, and a cutting set 60.

The support frame 10 is composed of two H-shaped legs 11, two frame bars 12 located respectively at the top of the legs 11, two bracing rods 13 for bracing the legs 11, and two folding rods 14 for folding and unfolding the H-shaped legs 11.

The movable bench top 20 is composed of two top plates 23A and 23B which are mounted on the support frame 10, two transmission threaded rods 21 received respectively in the receiving space of the frame bar 12 such that the transmission threaded rods 21 can be actuated by a rocking rod 211. The top plates 23A and 23B are provided with a locating block 24 in contact with the frame bar 12 such that the top plate 23A is fixed, and that the top plate 23B can be actuated by the transmission threaded rods 21 to move in relation to the top plate 23A. The top plates 23A and 23B are provided with a plurality of locating holes 231.

The locating and holding set 30 is composed of a horizontal member 31 and a longitudinal member 40. The horizontal member 31 has a first stop member 32 and an auxiliary stop member 35. The first stop member 32 is fastened with the top plate 23A by a locating pin 321 which is engaged with the locating hole 231. The first stop member 32 has a horizontal portion 322 provided with an arcuate slot 323 in which the locating pin 321 moves so as to adjust the angle of a vertical portion 324 of the first stop member 32 in accordance with the shape of a work piece. The horizontal portion 322 is provided with two threaded blocks 325 contiguous to the vertical portion 324 and engageable with the threaded portion 331 of a first shaft 33. The first shaft 33 is fastened at another end thereof with a locking member 34, which is provided with two through holes 341A and 341B. The first shaft 33 is engaged with the through hole 341A in conjunction with a bolt 342 engaging the through hole 341A.

The auxiliary stop member 35 has a second shaft 36 which is engaged with the through hole 341B of the locking member 34 in conjunction with a bolt 37 engaging the through hole 341B. The second shaft 36 is provided with a stop member 38. The auxiliary stop member 35 can be actuated to displace by the bolt 37.

The longitudinal member 40 is perpendicular to the horizontal member 31 and is provided with a threaded jacket 41 having a threaded hole 411 which is engaged with a threaded rod 42. The threaded rod 42 is provided with a rocking rod 421 and a stop member 43 capable of swiveling. The stop member 43 has an extension rod 431, which is capable of extending into a guide slot 50 located under the threaded rod 42. The stop member 43 can be manipulated by the rocking rod 421 to slide in the guide slot 50.

The cutting set 60 comprises the component parts which are described hereinafter.

A locating seat 62 is fastened with the movable top plate 23B of the bench top 20 and is provided at the center thereof with a threaded hole 621 and a plurality of insertion holes 622 arranged in the periphery of the threaded hole 621.

A rotary seat 63 is provided with a through hole 631 coaxial with the threaded hole 621 of the locating seat 62 and having a receiving cell 632 greater in diameter than the through hole 631. The rotary seat 63 is further provided with a plurality of locating pillars 633 corresponding in number to the insertion holes 622, and two upright support rods 64B parallel to each other.

A fastening bolt 65 is engaged with the threaded hole 621 of the locating seat 62 such that the head 651 of the bolt 65 covers the opening of the receiving cell 632 of the rotary seat 63, and that the locating seat 62 and the rotary seat 63 are fastened securely together.

A spring 66 is received in the receiving cell 632 such that the spring 66 is fitted over the bolt 65, and that one end of the spring 66 urges the bottom of the receiving cell 632, and further that another end of the spring 66 urges the head 651 of the bolt 65.

A hand saw 70 is provided with two fastening members 71 which are engaged with two support rods 64A and 64B of the rotary frames 61A and 61B such that the hand saw 70 can be adjusted upwards or downwards along the two support rods 64A and 64B.

The rotary seat 63 is urged by the spring 66 such that the locating pillars 633 can be adjusted in position in relation to the insertion holes 622. As the rotary seat 63 and the locating seat 62 are caused to swivel simultaneously, the hand saw 70, which is mounted on the support rods 64A and 64B, can be actuated to angularly swivel corresponding in degree to the swiveling angle of the rotary seat 63.

What is claimed is:

1. A workbench for woodworking, said workbench comprising:

a foldable support frame for supporting said workbench on a floor or ground surface;

a bench top composed of one fixed top plate and one movable top plate, and supported by said support frame;

a locating and holding set mounted on said bench top for holding and locating a work piece; and a cutting set comprising a saw mounted on support rods fastened with said bench top such that said saw can be angularly swiveled;

wherein said locating and holding set comprises a horizontal member composed of a first stop member and an auxiliary stop member, said first stop member being fastened with said fixed top plate of said bench top such that the angle of a vertical portion of said first stop member can be adjusted by a locating pin in accordance with the shape of the work piece, said locating pin being engaged with one of locating holes of said bench top, said first stop member having a horizontal portion provided with an arcuate slot in which said locating pin moves so as to adjust the angle of said vertical portion of said first stop member in accordance with the shape of the work piece, said first stop member further having a horizontal portion provided with two threaded blocks contiguous to said vertical portion and engageable with a threaded end of a first shaft which is fastened at another end thereof with one of two through holes of a locking member in conjunction with a first bolt, said auxiliary stop member having a second shaft which is engaged with another one of said two through holes of said locking member in conjunction with a second bolt capable of actuating said auxiliary stop member to displace, whereas said locating and holding set further comprises a longitudinal member perpendicular to said horizontal member and having a threaded jacket provided with a threaded hole, said longitudinal member further having a threaded rod which is engaged with said threaded hole of said threaded jacket and is provided with a rocking rod and a stop member capable of swiveling, said stop member having an extension rod capable of extending into a guide slot located under said threaded rod, said stop member capable of being manipulated by said rocking rod to slide in said guide slot;

wherein said cutting set comprises:

a locating seat fastened with said movable top plate of said bench top and provided with a threaded hole and a plurality of insertion holes surrounding said threaded hole;

a rotary seat provided with a through hole coaxial with said threaded hole of said locating seat, said through hole having a receiving cell greater in diameter than said through hole, said rotary seat further provided with a plurality of locating pillars corresponding in number to said insertion holes of said locating seat, said rotary seat still further provided with two upright support rods parallel to each other;

a fastening bolt engaged with said threaded hole of said locating seat such that a head of said fastening bolt covers an opening of said receiving cell of said through hole of said rotary seat;

a biasing means received in said receiving cell such that said biasing means is fitted over said fastening bolt, and that one end of said biasing means urges a bottom of said receiving cell, and further that another end of said biasing means urges said head of said fastening bolt; and wherein the saw which is fastened movably within said support rods such that said saw can be moved upwards or downwards along said support rods, and wherein the saw can be actuated to angularly swivel corresponding to an angular swiveling of said rotary seat which is caused to swivel along with said locating seat.

2. A workbench for woodworking, said workbench comprising:

a foldable support frame for supporting said workbench on a floor or ground surface;

a bench top composed of one fixed top plate and one movable top plate, and supported by said support frame;

a locating and holding set mounted on said bench top for holding and locating a work piece; and a cutting set comprising a saw mounted on support rods fastened with said bench top such that said saw can be angularly swiveled;

wherein said cutting set comprises:

a locating seat fastened with said movable top plate of said bench top and provided with a threaded hole and a plurality of insertion holes surrounding said threaded hole;

a rotary seat provided with a through hole coaxial with said threaded hole of said locating seat, said through hole having a receiving cell greater in diameter than said through hole, said rotary seat further provided with a plurality of locating pillars corresponding in number to said insertion holes of said locating seat, said rotary seat still further provided with two upright support rods parallel to each other;

a fastening bolt engaged with said threaded hole of said locating seat such that a head of said fastening bolt covers an opening of said receiving cell of said through hole of said rotary seat;

a biasing means received in said receiving cell such that said biasing means is fitted over said fastening bolt, and that one end of said biasing means urges a bottom of said receiving cell, and further that another end of said biasing means urges said head of said fastening bolt; and wherein the saw which is fastened movably within said support rods such that said saw can be moved upwards or downwards along said support rods, and wherein the saw can be actuated to angularly swivel corresponding to an angular swiveling of said rotary seat which is caused to swivel along with said locating seat.

3. The workbench according to claim 2, wherein said locating and holding set comprises a horizontal member composed of a first stop member and an auxiliary stop member, said first stop member being fastened with said fixed top plate of said bench top such that the angle of a vertical portion of said first stop member can be adjusted by a locating pin in accordance with the shape of the work piece, said locating pin being engaged with one of locating holes of said bench top, said first stop member having a horizontal portion provided with an arcuate slot in which said locating pin moves so as to adjust the angle of said vertical portion of said first stop member in accordance with the shape of the work piece, said first stop member further having a horizontal portion provided with two threaded blocks contiguous to said vertical portion and engageable with a threaded end of a first shaft which is fastened at another end thereof with one of two through holes of a locking member in conjunction with a first bolt, said auxiliary stop member having a second shaft which is engaged with another one of said two through holes of said locking member in conjunction with a second bolt capable of actuating said auxiliary stop member to displace, whereas said locating and holding set further comprises a longitudinal member perpendicular to said horizontal member and having a threaded jacket provided with a threaded hole, said longitudinal member further having a threaded rod which is engaged with said threaded hole of said threaded jacket and is provided with a rocking rod and a stop member capable of swiveling, said stop member having an extension rod capable of extending into a guide slot located under said threaded rod, said stop member capable of being manipulated by said rocking rod to slide in said guide slot.

* * * * *